US007419153B2

(12) United States Patent
Bürk et al.

(10) Patent No.: US 7,419,153 B2
(45) Date of Patent: Sep. 2, 2008

(54) METHOD AND APPARATUS FOR PRODUCING BOUND BOOKS, MAGAZINES OR BROCHURES

(75) Inventors: Richard Bürk, Reichenau (DE); Urs Mösli, Winterthur (CH)

(73) Assignee: Muller Martini Holding AG, Hergiswil (CH)

( * ) Notice: Subject to any disclaimer, the term of this patent is extended or adjusted under 35 U.S.C. 154(b) by 202 days.

(21) Appl. No.: 10/952,916

(22) Filed: Sep. 30, 2004

(65) Prior Publication Data

US 2005/0073083 A1 Apr. 7, 2005

(30) Foreign Application Priority Data

Oct. 2, 2003 (EP) ..... 03405710

(51) Int. Cl.
*B65H 3/14* (2006.01)

(52) U.S. Cl. ..... 271/98; 271/11; 271/12; 271/14; 271/100; 271/106; 271/107; 270/52.18

(58) Field of Classification Search ..... 271/11, 271/12, 14, 98, 100, 106, 107; 270/52.18
See application file for complete search history.

(56) References Cited

U.S. PATENT DOCUMENTS

| | | | | |
|---|---|---|---|---|
| 3,071,369 | A | 1/1963 | Ambrogi | |
| 3,552,740 | A * | 1/1971 | Hepp | 271/12 |
| 3,690,644 | A * | 9/1972 | Halbert | 271/98 |
| 4,830,352 | A * | 5/1989 | Birtwhistle | 270/58.29 |
| 6,530,322 | B1 | 3/2003 | Ono et al. | |

FOREIGN PATENT DOCUMENTS

| | | | |
|---|---|---|---|
| CH | 692 700 | A5 | 9/2002 |
| DE | 2 410 993 | A | 9/1974 |
| DE | 44 37 327 | A1 | 5/1995 |
| EP | 980 839 | A2 | 2/2000 |
| EP | 1 167 254 | A2 | 1/2002 |
| EP | 1 197 449 | A1 | 4/2002 |
| EP | 1 228 990 | A2 | 8/2002 |
| EP | 1 270 477 | A1 | 1/2003 |
| GB | 829 518 | | 3/1960 |

* cited by examiner

*Primary Examiner*—Gene O. Crawford
*Assistant Examiner*—Leslie A Nicholson, III
(74) *Attorney, Agent, or Firm*—Venable; Robert Kinberg; Ryan M. Flandro

(57) ABSTRACT

A method for producing bound books, magazines or brochures by gathering printed sheets into non-bound book blocks along a conveying section that is supplied by at least one sheet feeder includes separating the lowest printed sheet from a stack of printed sheets by lifting one edge region of the lowest printed sheet from the bottom of the printed sheet stack, withdrawing the separated lowest printed sheet with the aid of a conveying element from the remaining sheet stack by gripping the separated edge region with the conveying element, and subsequently withdrawing the separated lowest printed sheet in a direction parallel to the longitudinal extension of the edge region of the remaining sheet stack. The apparatus includes a separating device that lifts up the printed sheet at the stack front and a conveying element that pulls the printed sheet from the stack where both are arranged jointly on a removal unit.

37 Claims, 5 Drawing Sheets

METHOD AND APPARATUS FOR PRODUCING BOUND BOOKS, MAGAZINES OR BROCHURES

CROSS-REFERENCE TO RELATED APPLICATION

This application claims the priority of European Patent Application No. 03405710.9, filed on Oct. 2, 2003, the subject matter of which is incorporated herein by reference.

BACKGROUND OF THE INVENTION

One exemplary embodiment of the invention relates to a method for producing bound books, magazines or brochures by gathering printed signatures into unbound book blocks along a conveying section that is supplied by at least one sheet feeder, wherein the printed signatures or sheets are respectively lifted up along one edge region at the front of the printed sheet stack and are then withdrawn from the stack by means of a conveying element. Another exemplary embodiment of the invention also relates to an apparatus for producing bound books, magazines, or brochures by gathering printed signatures along a conveying section, the apparatus comprising a conveyor provided with carriers and at least one feeder, arranged above the conveyor, which supplies the latter with printed signatures or sheets removed from a stack front. The feeder in turn is provided with a separating device, which lifts up an exposed edge region of the printed signature or sheet on the front of the stack, as well as a conveying element that pulls the printed signature or sheet off at the stack front.

Swiss patent document CH 692 700 A5 discloses a gathering and collating machine provided with a series of feeding stations, which respectively comprise a magazine for receiving a stack of printed sheets and a device for separating the respectively lowest printed sheet. The gathering and collating machine furthermore comprises a gathering conveyor with driven carriers in a gathering channel to which the separated printed sheets are supplied for the stack formation. For one embodiment according to CH 692 700 A5, the stack of printed sheets is positioned above the gathering channel on a conveyor belt, provided with suction openings, wherein one side region with fold is left exposed in the printed sheet-conveying direction. The underside of the printed sheet is advanced far enough with the suction belt, so that it can be transported further by a subsequently installed withdrawing conveyor. Compressed air can be supplied via the lowest printed sheet that is slanted toward the side by means of the suction element for reducing the friction between the printed sheet to be pulled off and the one positioned above. A so-called pass-through guide is provided at the magazine discharge opening, which can be used to form an adjustable pass-through gap above the conveyor belt, so that respectively only the lowest printed sheet with fold is pulled from the stack.

This known separating device can be used for feeding sheets in longitudinal as well as transverse direction to the gathering channel.

One disadvantage of this separating device, however, is that the pass-through gap on the magazine discharge opening must be adjusted for holding back the subsequently arriving sheet. This operation results in considerable expenditure not only for thin printed sheets with folds, but for small format printed sheets with folds as oftentimes the small format printed sheets with folds do not have a large enough area of contact with the conveying belt, thus making a reliable separation impossible.

SUMMARY OF THE INVENTION

In order to provide reliable separation and careful handling of printed signatures or large sheets, it is an object of the present invention to create a simple device which makes possible the uninterrupted separation of printed signatures or large sheets from a stack.

In one aspect of the invention, a method for producing bound books, magazines or brochures by gathering printed sheets into non-bound book blocks along a conveying section that is supplied by at least one sheet feeder is described. The method includes separating the lowest printed sheet from a stack of printed sheets by lifting one edge region of the lowest printed sheet from the bottom of the printed sheet stack, withdrawing the separated lowest printed sheet with the aid of a conveying element from the remaining sheet stack by gripping the separated edge region with the conveying element, and subsequently withdrawing the separated lowest printed sheet in a direction parallel to the longitudinal extension of the edge region of the remaining sheet stack.

In another aspect of the invention, an apparatus for producing bound books, magazines or brochures by gathering printed sheets along a conveying section includes a conveyor and at least one sheet feeder that is arranged above the conveyor and supplies the conveyor with printed sheets, which are individually removed from a front of a sheet stack, wherein the sheet feeder includes a separating device for separating an exposed edge region of the lowest printed sheet from the front of the sheet stack front and a conveying element that withdraws the separated, lowest printed sheet from the remaining sheet stack front wherein the separating device and the conveying element are jointly arranged on a removal unit.

Thus, according to an aspect of the invention, the foregoing object is achieved in that the edge region of a printed signature or sheet is gripped by the conveying element for lifting it off the stack and is subsequently pulled off the stack parallel to the longitudinal extension of the edge region, wherein the separating device and the conveying element are jointly arranged on a removal unit.

BRIEF DESCRIPTION OF THE DRAWINGS

The foregoing and other features and advantages of the invention will be apparent from the following description of an exemplary embodiment, as illustrated in the accompanying drawings to which we expressly refer for all details not mentioned in the description, wherein the drawings show as follows.

DETAILED DESCRIPTION OF THE INVENTION

Figure 1:
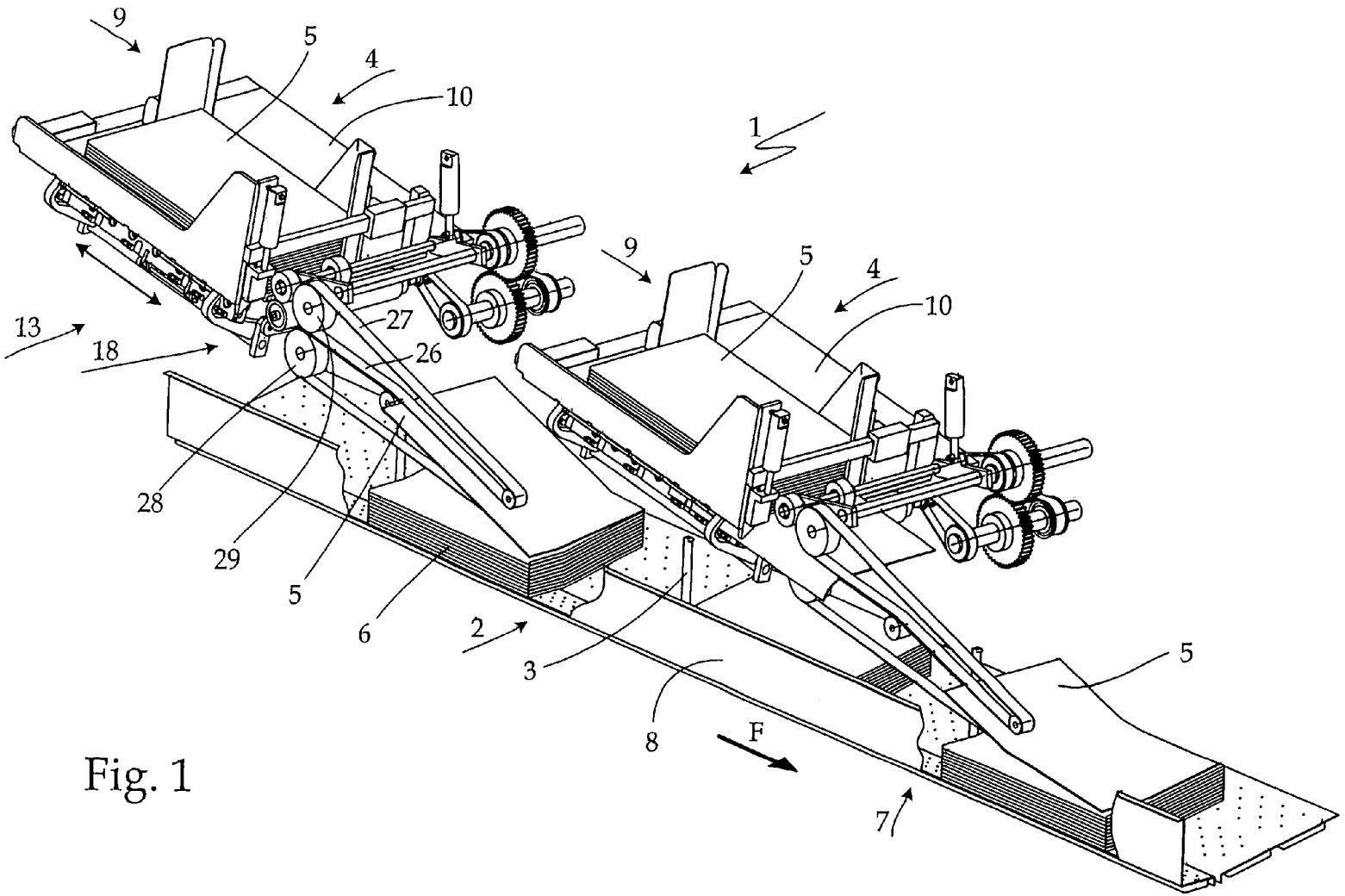
FIG. 1 illustrates portions of a three-dimensional view of a device according to one embodiment of the invention.
Figure 2:
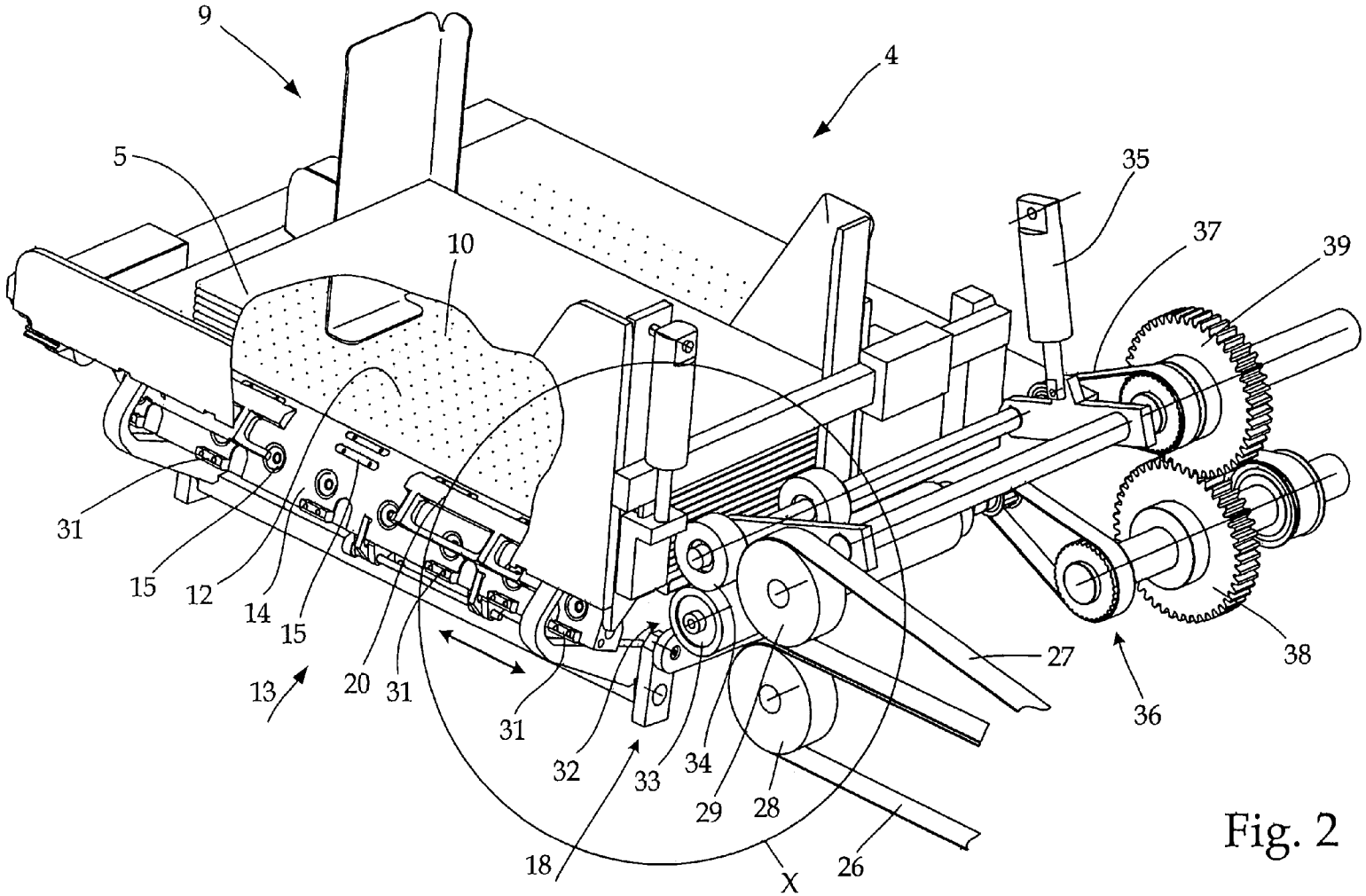
FIG. 2 is an enlarged view of a feeder for the device according to FIG. 1.

FIG. 1 shows a device 1, also called a gathering and collating machine, which basically includes a conveyor 2 with carriers 3 and sequentially arranged sheet feeders 4, installed above conveyor 2. Sheet feeders 4 may supply conveyor 2 with printed sheets 5 approximately in the conveying direction F.

However, the printed sheets could also be supplied perpendicular to conveying direction F by sheet feeders 4, in a manner known per se, thereby changing the conveying direction of printed sheets 5 inside the conveyor 2.

The carriers 3 are mounted on an endless traction element (not shown herein) and function to convey loose (unbound) book blocks 6 that are formed with printed sheets 5 through a conveying channel 7, on the side viewed as the back side as seen in conveying direction. The conveying channel is provided with an upright guide wall 8 on the right side, as seen in conveying direction F.

The sheet feeders 4 are provided with a magazine 9 in which the printed sheets 5 are stacked on top of a magazine bottom 10.

The magazine bottom 10 is provided with an approximately rectangular opening 11 at one side end of magazine 9 for removing the respectively lowest printed sheet 5 in the stack from the magazine 9, wherein the opening 11 is shown in FIGS. 1 and 4*a* to 4*c*. The magazine bottom 10 is designed to have compressed air openings 12 through which compressed air is supplied from the underside of magazine bottom 10 to the area between the magazine bottom 10 and the printed sheet stack. As can be seen, magazine 9 is designed to be format-adjustable.

In an exemplary embodiment of the invention, printed sheets 5 are stacked inside magazine 9 and are provided with a final fold on the right-hand side, as seen in conveying direction F.

A driven removal unit 13 is provided as a separating device, which respectively grips an exposed edge of the lowest printed sheet 5, having a fold herein, through the opening 11 in the magazine bottom 10. Following the withdrawal of a printed sheet 5, the removal unit furthermore takes on the function of the conveying element. The displacement movements of the removal unit for transporting the lowest printed sheet 5 out of the magazine are controlled, for example, by cam drives or linear drives.

Removal unit 13 functions as a separating device and includes a convex support surface 14 disposed along the opening 11. Convex support surface 14 contains suction openings 15 that are connected to a vacuum source and aids in the separation of a printed sheet 5 from a stack of printed sheets. Support surface 14 removes the printed sheet 5, which is held in place by a vacuum in the edge region of the support surface 14, from the stack with the aid of a roll-off movement as illustrated in FIG. 4*b*. That is to say, the removal unit 13 carries out a combination rotation and translation movement for this separation. For this purpose, the support surface 14 of the removal unit 13 is provided with a circular surface, formed by a rotational axis 16 of the rotational movement. Convex support surface 14 moves at the level of the magazine bottom 10 or at a minimum distance above it during the separation operation.

Distributed along the front end of support surface 14 of removal unit 13 are several blow nozzles 31, which are activated as soon as the suction through openings 15 starts, so as to supply blast air between the individual printed sheets 5 in the lower region of the sheet stack. This is designed to support the separation operation which has higher requirements, especially for thin or porous printed sheets.

The translational movement of removal unit 13, horizontal and crosswise to the longitudinal extension of the fold edge herein, takes place along a stationary spur and/or toothed rack 30 that meshes with a spur gear and/or toothed segment 17 which is connected to removal unit 13 at rotational axis 16.

With a subsequent translational movement of removal unit 13 in conveying direction F, the lowest printed sheet 5 in the stack that is held by suction is pushed out of the magazine 9 with the aid of blast air, supplied to the top side of magazine bottom 10, so that it can be taken over by a downstream connected transporting device 18.

The printed sheet 5, which rests with its edge region on support surface 14, is thus provided with a higher rigidity which has proven advantageous for preserving the form when it is pushed out of magazine 9.

Figure 4A:
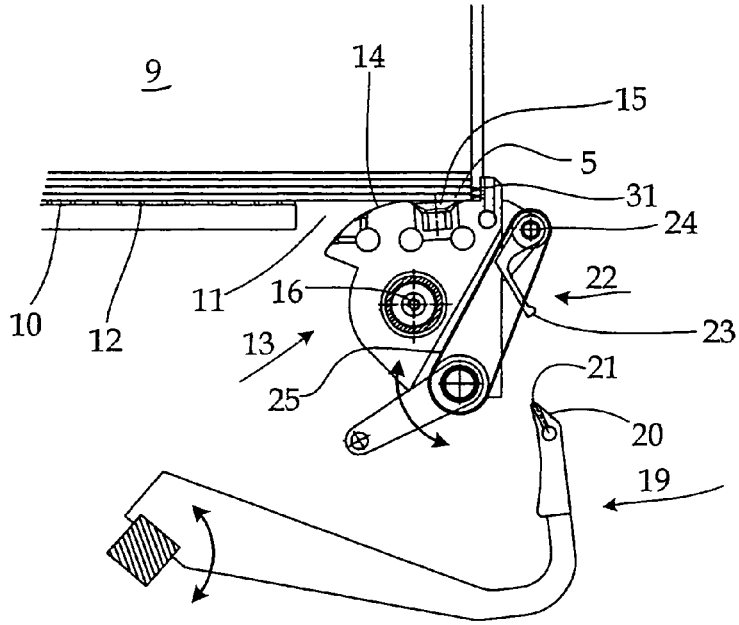
FIGS. 4*a*-4*c* are sequential views of functional processing steps of the conveying element on the feeder.
Figure 4B:
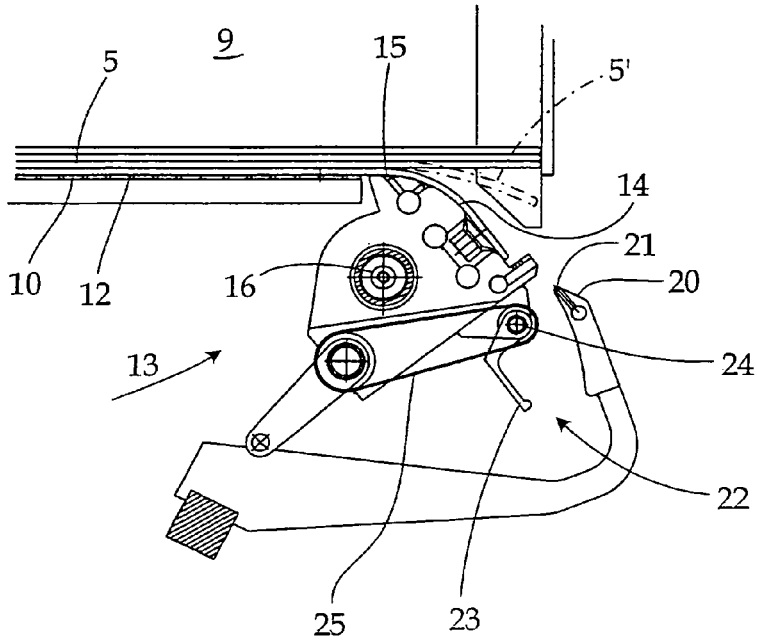
Figure 4C:
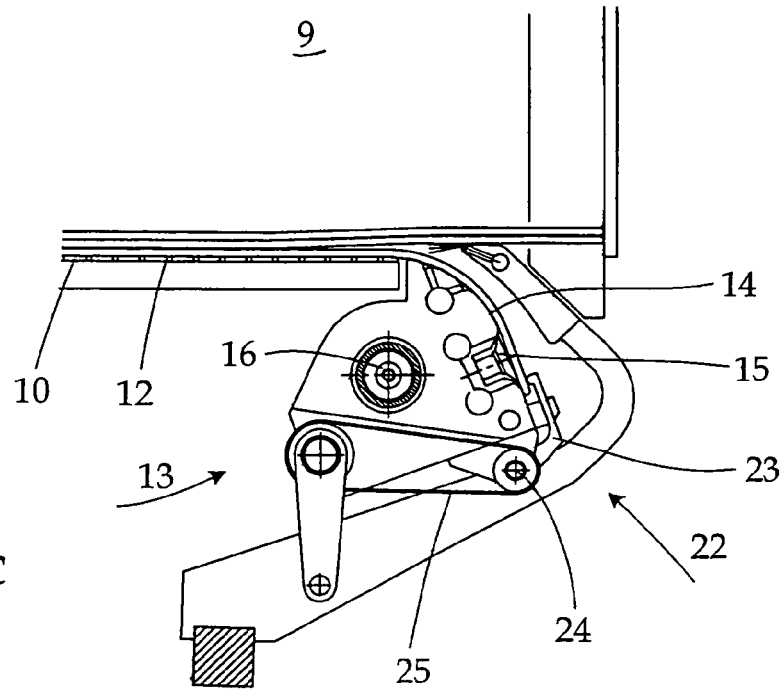
Figure 5:
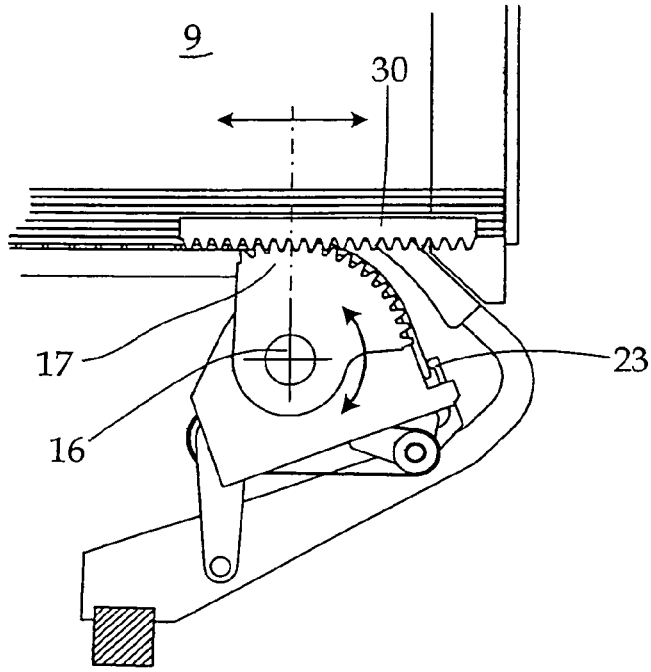
FIG. 5 is a partial view showing a mechanical drive for the removal unit for separating out a printed sheet from the stack.

FIGS. 4*a* to 4*c* show the individual steps for the separation operation. The removal unit 13 according to FIG. 4*a* is in a starting position, directly below the lowest printed sheet 5 to be separated from the stack in the edge region. In this extreme position of removal unit 13, the printed sheet is held against support surface 14 with a small edge region by means of a vacuum that starts at openings 15. Support surface 14 may be provided with several rows of suction openings 15 that may be arranged side-by-side in the withdrawing direction of the lowest printed sheet 5. The removal unit 13 is subsequently turned clockwise and is simultaneously also displaced in a horizontal direction to the left (see FIG. 4*b*). The edge region of printed sheet 5 (see also FIG. 4*c*), which is held with increasing force against support surface 14 by the removal unit 13, is bent toward the bottom while the position of the lowest printed sheet 5 above the magazine bottom 10 remains unchanged for the moment. As a result of the rolling off movement of the removal unit 13—which occurs in planes that are perpendicular to the movement for withdrawing the printed sheets 5 from the magazine 9—the adhering effect of the printed sheet 5 edge region at the withdrawing unit of removal unit 13 (FIG. 4*b*) increases as a result of the activation of additional suction openings 15 on support surface 14.

The removal unit 13 equals at least approximately the length of the edge region of the largest printed sheet to be gripped.

To ensure that the edge region quickly separates from support surface 14, compressed air can be supplied via the suction openings 15 to removal unit 13 just prior to transferring the printed sheet 5 to the transporting device 18. The compressed air helps separate the printed sheet 5 from support surface 14 once the vacuum is turned off. During the separating operation with the removal unit 13, a support element 19 is pivoted from below against the exposed edge of the remaining stack. That is, support element 19 may be inserted into the gap formed by the separated printed sheet 5 and the remaining stack. The support element 19 is provided at the supporting end with a support surface 20 for lifting the remaining stack over the length of the edge region slightly off the lowest printed sheet 5 and is designed to have openings 21 along its edges for supplying compressed air to the stacked printed sheets. Support surface 20 may be planar. As shown in FIGS. 4*a* to 4*c*, it is possible to supply compressed air via the support element 19 into the gap, formed by the separated edge region of printed sheet 5 and the remaining stack of printed sheets. The compressed air reduces the friction between the lowest printed sheet and the remaining stack, thus further reducing the friction during the withdrawal of the lowest printed sheet 5. In another embodiment, a planar support 20 may be provided with suction openings that face the remaining stack and are coupled to a vacuum source.

A gripping device 22, which is mounted on removal unit 13 and extends over the length of the edge region of a printed sheet 5 that can be gripped, can be used to press a printed sheet 5 with additional force onto support surface 14. The gripping device 22 comprises several gripping arms 23 which can be mounted, for example, on a controlled gripper shaft 24. The gripper shaft 24 is connected to a controlled belt drive gear 25.

Along the edge region of printed sheet 5, the removal unit 13 is provided with several rows of suction openings 15 which can be activated with the approach of support surface 14.

The downstream connected transporting device 18, which is driven synchronously with the removal unit 13 in the withdrawing direction, discharges with a conveying end onto the conveyor 2. The transporting device 18 comprises two conveying belts 26, 27, driven to circulate endlessly around deflection rollers 28, 29, wherein two adjacent conveying belt sections form a conveying gap for the printed sheets 5 fed in by the removal unit 13.

The transporting device 18 is provided with a withdrawing device 32, consisting of driven rollers 33, 34 that are arranged one above the other to form a withdrawing gap, wherein the withdrawing device 32 is installed upstream of the deflection rollers 28, 29. The lower roller 33 is stationery while the upper roller 34 is advanced flexibly and with the timing of the printed sheet feeder 4 against the lower roller 33. A drive element 35, shown as linear drive herein, functions to move the upper roller/rollers 34 toward or away from the lower roller(s).

The rollers 33, 34 are driven so as to be rotated by two belt drives 36, 37 with respectively assigned gearwheels 38, 39, which engage.

Figure 3:
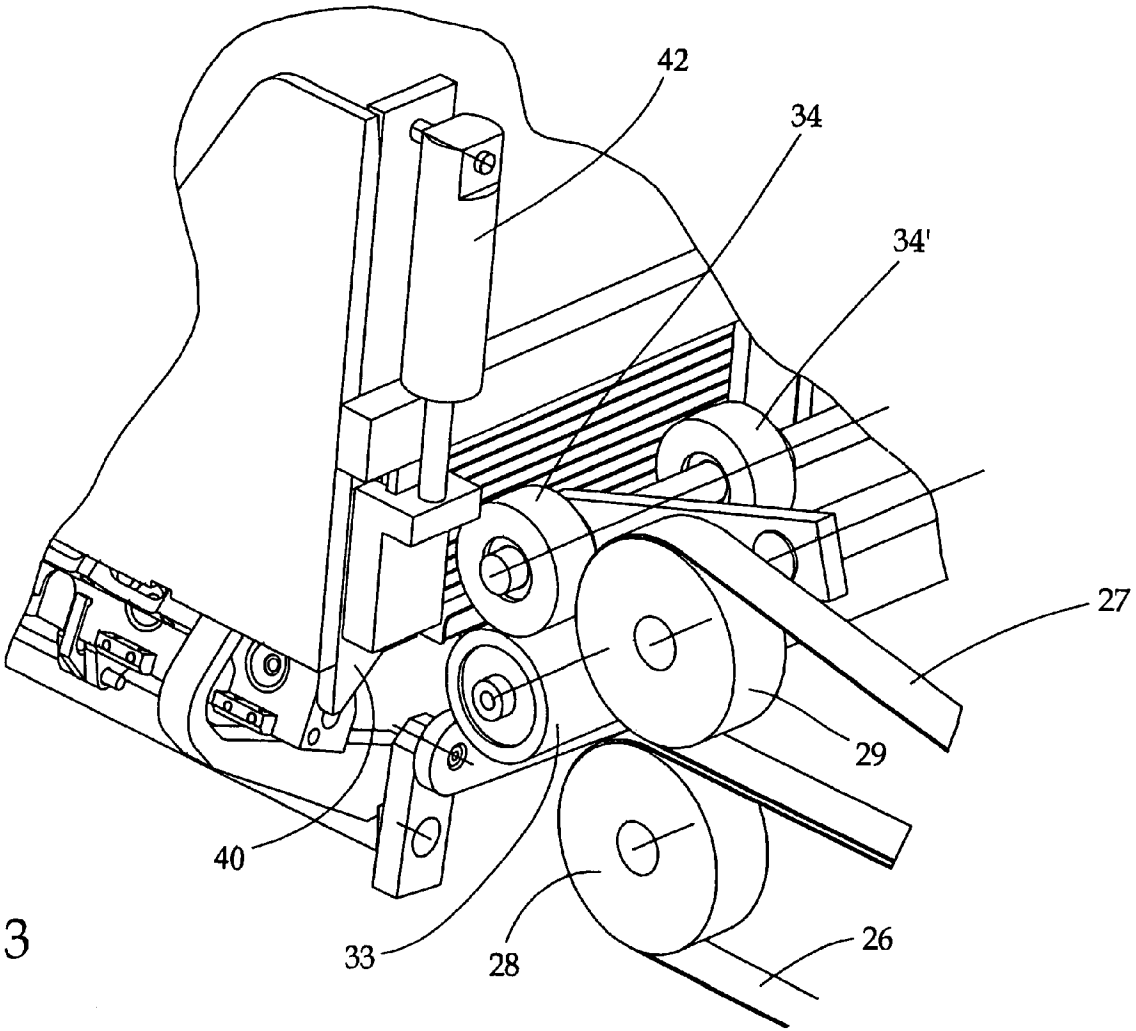
FIG. 3 is an enlarged view of detail X in FIG. 2 showing a conveying device installed downstream of the printed sheet feeder.

Of the rollers 34, the rear roller 34' in FIG. 3 may be axially adjustable, so that it can be adapted to different printed sheet formats. In an exemplary embodiment, rollers 33, 34 may grip the withdrawn printed sheet 5 exclusively in the flat surface area.

As a result of the conveying gap in the transporting device 18, formed by conveying belts 26, 27 and slanted in conveying direction 2, removal unit 13 and magazine 9, arranged above it, could also be slanted in the conveying direction. Thus, the printed sheet 5 which is moved by the removal unit 13 across the magazine bottom 10 is supplied in a straight line to the intake gap of the transporting device 18. The withdrawing direction of removal unit 13 is approximately in the same direction as the conveying direction of conveyor 2.

A retaining element 40 is arranged to the side of opening 11 to prevent the lowest printed sheet 5' in the remaining stack from being carried along as a result of friction and due to a slight hanging in the edge region (as shown with dash-dot line in FIG. 4*b*) when the lowermost printed sheet 5 is removed. This retaining element projects below the level of the magazine bottom 10 and thus forms an extended guide for the remaining printed sheets in the stack. The retaining element 40 is arranged at the back end of the magazine 9, as seen in ejection direction, and is in a lower end position no later than at the start of the ejection operation, which prevents a multiple withdrawal of printed sheets from the remaining stack. The retaining element 40 moves in time with the withdrawal cycle for printed sheets 5 by oscillating in perpendicular direction.

For an uninterrupted return movement of the removal unit 13, during which a reversible rolling-off movement also takes place, the retaining element 40 must be retracted toward the top by element 42.

The operational steps required for transferring the printed sheet to the transporting device 18 are as follows:

The printed sheet 5 which adheres to the removal unit 13 is pushed out from under the remaining stack and into the conveying gap, formed by rollers 33, 34, and/or into the transporting device 18. The removal device 13, the withdrawal device 33, 34 and the transporting device 18 all operate at the same conveying speed.

The removal unit 13 briefly accompanies the printed sheet, the vacuum is then turned off, and the reversal of the removal unit 13 to the starting position is subsequently initiated. With the vacuum turned off, the suction openings 15 could also be used to supply blast air to facilitate the separation of the printed sheet 5 from the removal unit.

To support the operation of separating the lowest printed sheet 5 from the remaining stack, the removal unit 13 is provided with blast air nozzles 31 that are distributed over the front end of support surface 14 and face the lower stack region.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for producing bound books, magazines or brochures by gathering printed sheets into non-bound book blocks along a conveying section that is supplied by at least one sheet feeder, comprising:

separating an edge region of a lowest printed sheet from a bottom of a stack of printed sheets with a removal unit by pivoting the removal unit about an axis extending parallel to the edge region of the lowest printed sheet; and withdrawing the lowest printed sheet from the stack of printed sheets by moving the removal unit linearly in a withdrawing direction extending parallel to the axis.

2. The method according to claim 1, wherein the edge region is provided with a fold.

3. The method according to claim 1, wherein the withdrawing direction is approximately the same direction as a conveying direction of the conveying section.

4. The method of claim 1, further comprising transporting the separated lowest printed sheet toward the conveying section with a transporting device.

5. The method according to claim 4, wherein the transporting device is installed downstream of the removal unit in the withdrawing direction, said transporting device being driven synchronously with said removal unit.

6. The method according to claim 5, wherein said transporting device discharges into the conveying section.

7. The method according to claim 5, wherein said transporting device and said removal unit are configured to move the lowest printed sheet with the same conveying speed.

8. An apparatus for producing bound books, magazines or brochures by gathering printed sheets along a conveying section, comprising:

a conveyor; and at least one sheet feeder arranged above the conveyor and adapted to supply the conveyor with printed sheets from a stack of printed sheets, wherein the sheet feeder comprises:

a removal unit pivotable about an axis extending parallel to an edge region of a lowest printed sheet of the stack of printed sheets to separate the edge region of the lowest printed sheet from the stack of printed sheets, wherein the removal unit is linearly movable in a withdrawing direction to withdraw the separated, lowest printed sheet from the stack of printed sheets, the withdrawing direction extending parallel to the axis.

9. The apparatus according to claim 8, wherein the removal unit has a support surface that is adapted to face the edge region of the lowest printed sheet, said support surface containing suction openings connected to a vacuum source for separating the edge region of the lowest printed sheet.

10. The apparatus according to claim 9, wherein the removal unit is configured for rotational and translational movement for separating the edge region of the lowest printed sheet from the remaining stack and said removal unit is adapted to be driven in the withdrawing direction and perpendicular to the separating movement for withdrawing lowest printed sheet from the remaining stack.

11. The apparatus according to claim 9, wherein said support surface is pivotable about the axis.

12. The apparatus according to claim 11, wherein said support surface has a contour adapted to contact the exposed edge region of the lowest printed sheet.

13. The apparatus according to claim 9, wherein a gripping device attached to the removal unit presses the edge region of the lowest printed sheet onto the support surface.

14. The apparatus according to claim 9, wherein said removal unit has blow nozzles which are distributed across a front end of said support surface and are adapted to face a lower region of the printed sheet stack.

15. The apparatus according to claim 8, wherein the support surface is pivotable about the axis in a plane perpendicular to the withdrawing direction.

16. The apparatus according to claim 8, wherein said removal unit further includes means for supplying compressed air into a gap formed between the lowest printed sheet and the remaining sheet stack when the edge region of the lowest printed sheet is separated.

17. The apparatus according to claim 16, further comprising a support element adapted to be positioned under an exposed edge region of the remaining sheet stack when the lowest printed sheet is withdrawn.

18. The apparatus according to claim 17, wherein said support element has a pivot about which said support element moves into position under the exposed edge region of the remaining stack and out of position away from remaining stack.

19. The apparatus according to claim 17, wherein the end of said support element, which faces the remaining stack, forms a support plane.

20. The apparatus according to claim 19, wherein the support plane of said support element has suction openings that face the remaining stack and are connected to a vacuum source.

21. The apparatus according to claim 17, wherein a front end of said support element is insertable into a gap formed between the separated printed sheet and the remaining stack, and has openings for supplying compressed air to the gap.

22. The apparatus according to claim 8, further comprising a magazine having a bottom onto which the printed sheets are stacked.

23. The apparatus according to claim 22, wherein a support surface of said removal unit faces the stack of printed sheets and is arranged at least at a level of the magazine bottom or above it.

24. The apparatus according to claim 23, wherein said support surface includes a plurality of suction openings arranged side-by-side in the withdrawing direction.

25. The apparatus according to claim 24, wherein the suction openings are activatable when said support surface approaches the edge region of the lowest printed sheet.

26. The apparatus according to claim 22, further comprising means for supplying compressed air to a top surface of the magazine bottom that accommodates the stack of printed sheets.

27. The apparatus according to claim 26, wherein said means for supplying compressed air include nozzles distributed across the bottom of said magazine, said nozzles adapted to supply compressed air to match a support surface area of a predetermined printed sheet format.

28. The apparatus according to claim 8, further comprising a transporting device installed downstream of the removal unit, said transporting device being driven synchronously with said removal unit.

29. The apparatus according to claim 28, wherein said transporting device discharges into the conveyor.

30. The apparatus according to claim 8, wherein said transporting device is formed by a conveying gap formed between the conveying sections of two endlessly circulating belts.

31. The apparatus according to claim 30, wherein said transporting device has a withdrawing device that is installed upstream of the conveying sections, as seen in the withdrawing direction.

32. The apparatus according to claim 31, wherein said withdrawing device includes driven rollers arranged one above the other to form a withdrawing gap, said rollers gripping the printed sheet at a level surface area.

33. The apparatus according to claim 28, wherein said transporting device and said removal unit are configured to move the lowest printed sheet with the same conveying speed.

34. The apparatus according to claim 28, wherein the transporting device is positioned at a slant relative to the conveyor.

35. The apparatus according to claim 8, further comprising a magazine having a bottom onto which printed sheets are stacked wherein the bottom of said magazine has an opening at one side thereof and a retaining element is disposed at the back of the magazine, as seen in the withdrawing direction, said retaining element being arranged to hold a lower region of the remaining stack.

36. The apparatus according to claim 35, wherein said retaining element is arranged to be driven synchronous with the removal unit while oscillating in a direction perpendicular to the withdrawing direction.

37. The apparatus according to claim 8, wherein the withdrawing direction of said removal unit is approximately the same direction as a conveying direction of the conveyor.

* * * * *